US007765991B2

(12) United States Patent
Thomas et al.

(10) Patent No.: US 7,765,991 B2
(45) Date of Patent: Aug. 3, 2010

(54) FUEL DELIVERY CONTROL FOR INTERNAL COMBUSTION ENGINE

(75) Inventors: Joseph Thomas, Kimball, MI (US); James Kerns, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 980 days.

(21) Appl. No.: 11/463,489

(22) Filed: Aug. 9, 2006

(65) Prior Publication Data

US 2008/0035122 A1 Feb. 14, 2008

(51) Int. Cl.
*F02M 33/02* (2006.01)

(52) U.S. Cl. ..... 123/520; 123/690; 701/107

(58) Field of Classification Search ..... 123/357, 123/456, 494, 497, 520, 690; 701/104, 107
See application file for complete search history.

(56) References Cited

U.S. PATENT DOCUMENTS 5,723,780 A 3/1998 Miwa et al.
6,024,064 A 2/2000 Kato et al.
6,032,639 A 3/2000 Goto et al.
6,125,832 A 10/2000 Toyohara et al.
6,148,809 A * 11/2000 Cinquegrani ..... 123/683
6,443,138 B1 * 9/2002 Franks et al. ..... 123/698
2005/0263146 A1 12/2005 Oono et al.

FOREIGN PATENT DOCUMENTS

JP 2004 027951 1/2004

* cited by examiner

*Primary Examiner*—Thomas N Moulis
*Assistant Examiner*—J. Page Hufty
(74) *Attorney, Agent, or Firm*—Julia Voutyras; Alleman Hall McCoy Russell & Tuttle LLP

(57) ABSTRACT

A method of controlling an internal combustion engine having a fuel vapor purging system and a fuel delivery system including a fuel pump and a fuel pressure sensor for detecting the fuel pressure provided by the fuel pump is disclosed. In one example, the method includes, during a degraded condition of the fuel pressure sensor, adjusting the fuel pump output in response to an operating condition, adjusting at least one of a condition of the fuel vapor purging system and adaptive learning of a characteristic of the fuel delivery system; and further adjusting the fuel pump output in response to an output of an exhaust gas sensor while also adjusting an amount of fuel injected into a cylinder of the engine in response to said output of the exhaust gas sensor.

20 Claims, 4 Drawing Sheets

FUEL DELIVERY CONTROL FOR INTERNAL COMBUSTION ENGINE

BACKGROUND AND SUMMARY

Internal combustion engines can utilize a fuel delivery system including a fuel pump for maintaining sufficient fuel pressure. In some conditions, the fuel pump may be operated to control the fuel pressure in response to a fuel pressure sensor located, for example, in a fuel rail or accumulator of the fuel system. In this way, the fuel pressure sensor can provide feedback control to the fuel pump so that the desired fuel delivery may be achieved.

During some conditions, such as in the event of fuel pressure sensor degradation or other degraded operating states, fuel pressure control may be reduced, thereby reducing the accuracy of fuel delivery to the engine. For example, the air/fuel ratio may be richer or leaner than desired potentially causing reduced engine efficiency and/or increased exhaust emissions. In one approach, as set forth in US 2005/0263146, a fuel sensor diagnosis may be performed, wherein the fuel pressure may be estimated based on the air/fuel ratio where an abnormal condition of the fuel pressure sensor occurs.

However, the inventors herein have recognized that other operations may exacerbate the potential error associated with a degraded fuel pressure sensor. For example, if a fuel vapor purging system is operated during conditions where the exhaust gas sensor is used to provide fuel pressure feedback, uncertainties in the amount and/or concentration of the fuel vapors purged to the engine may result in an inaccurate fuel pressure. Likewise, uncertainties in these parameters with adaptive learning of fuel injector characteristics, for example, during conditions where the exhaust sensor is used to provide fuel pressure feedback, may result in inaccurate fuel pressure.

In one approach, the above issues can be addressed by a method of controlling an internal combustion engine having a fuel vapor purging system and a fuel delivery system including a fuel pump and a fuel pressure sensor for detecting the fuel pressure provided by the fuel pump, the method comprising: during a degraded condition of the fuel pressure sensor, adjusting the fuel pump output in response to an operating condition, adjusting at least one of a condition of the fuel vapor purging system and adaptive learning of a characteristic of the fuel delivery system; and further adjusting the fuel pump output in response to an output of an exhaust gas sensor while also adjusting an amount of fuel injected into a cylinder of the engine in response to said output of the exhaust gas sensor.

In this way, by adjusting (e.g., by reducing and/or discontinuing) fuel vapor purging operations and/or adaptive learning during a degraded state of the fuel pressure sensor, fuel pressure control may be improved.

Note however, that alternative embodiments not necessarily related to adjusting fuel vapor purging and/or adaptive learning may also lead to advantageous results.

DETAILED DESCRIPTION

Figure 1:
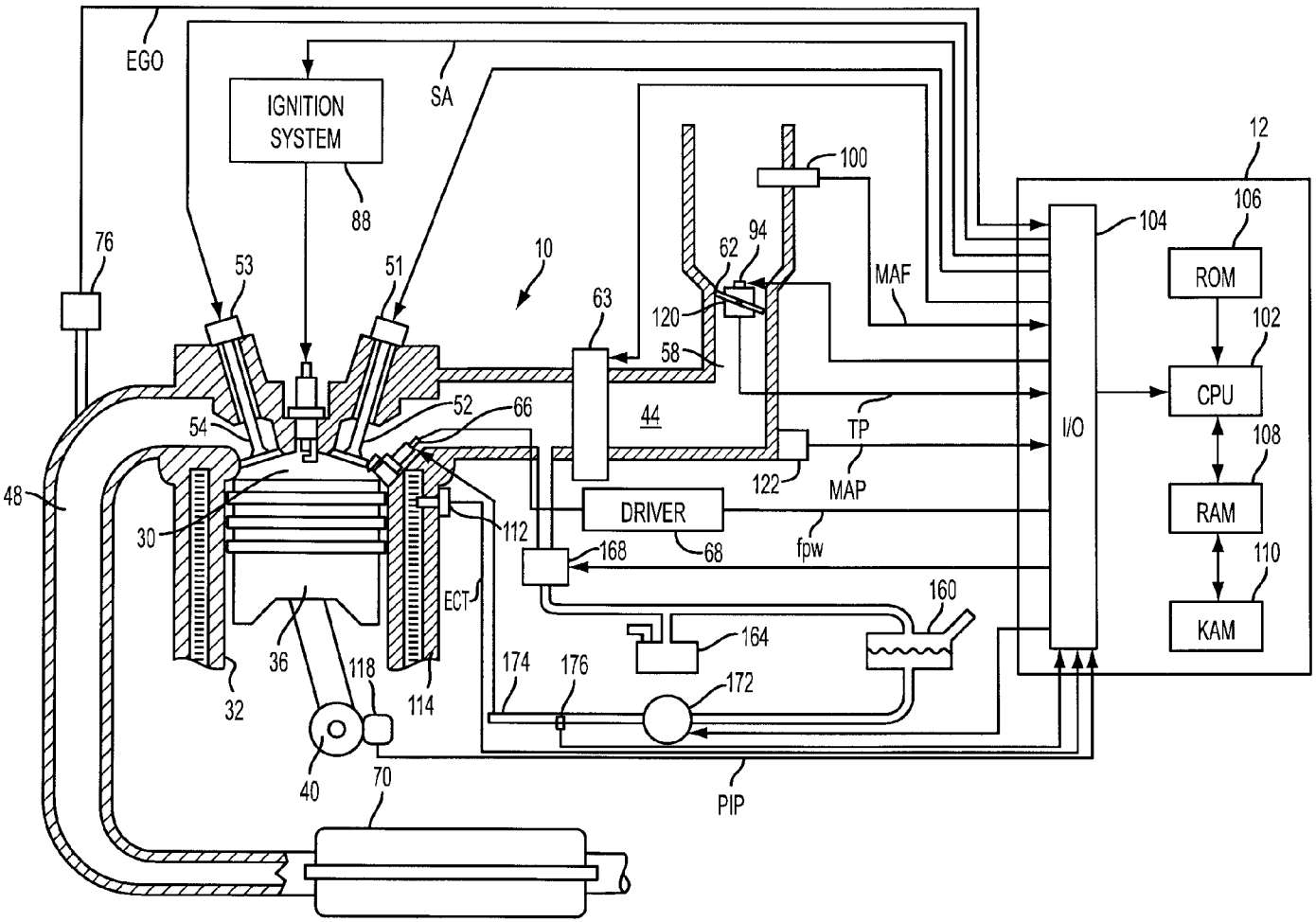
FIG. 1 shows a partial view of an example internal combustion engine.

Referring to FIG. 1, one cylinder of multi-cylinder internal combustion engine 10 is shown, as well as the intake and exhaust path connected to that cylinder. In some embodiments, engine 10 may be a portion of a propulsion system for a passenger vehicle. Combustion chamber or cylinder 30 of engine 10 is shown including combustion chamber walls 32 with piston 36 positioned therein and connected to crankshaft 40. A starter motor (not shown) may be coupled to crankshaft 40 via a flywheel (not shown). Cylinder 30 can communicate with intake manifold 44 and exhaust manifold 48 via respective intake valve 52 and exhaust valve 54. While cylinder 30 is shown having only one intake valve and one exhaust valve, it should be appreciated that cylinder 30 may have two or more intake and/or exhaust valves.

Intake and exhaust valve control can be provided by signals supplied by controller 12 via valve actuators 51 and 53, respectively. In some embodiments, one or more of actuators 51 and 53 may include electric valve actuation (EVA). In some embodiments, one or more of actuators 51 and 53 may be used to provide valve control via other mechanical control systems including cam profile switching (CPS), variable cam timing (VCT), variable valve lift (VVL) and/or variable valve timing (VVT). In some embodiments, valve control may be provided by a combination of EVA and one or more of CPS, VCT, VVL, and/or VVT. In this manner, actuators 51 and 53 can be operated by the control system to vary a valve opening event timing, a valve closing event timing, a valve lift duration, a valve lift amount, etc.

Fuel injector 66 is shown directly coupled to combustion chamber 30 for delivering injected fuel directly therein in proportion to the pulse width of signal fpw received from controller 12 via electronic driver 68. Fuel is delivered to fuel injector 66 by a high pressure fuel system including a fuel tank 160, fuel pump 172, and a fuel rail 174. In some embodiments, the fuel rail may include an accumulator for holding a quantity of pressurized fuel sufficient to reduce rapid pressure transients caused by fuel being injected into the cylinder. A fuel rail pressure sensor 176 can provide controller 12 with the fuel pressure within the fuel rail. Further, it should be appreciated that the fuel delivery system shown in FIG. 1 may be configured to similarly provide fuel to one or more other cylinders of engine 10. Engine 10 is described herein with reference to a gasoline burning engine; however engine 10 may be configured to utilize a variety of fuels including gasoline, diesel, alcohol, and combinations thereof.

Fuel vapors originating in fuel tank 160 can be stored in a fuel vapor storage canister 164. These fuel vapors may be purged to cylinder 30 via the intake manifold by controlling fuel vapor purge valve 168, which is shown operatively coupled to controller 12. In this manner, fuel vapors may be stored and purged during some conditions to one or more cylinders of the engine where they are combusted.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized during idle speed control. In an alternative embodiment, which is well known to those skilled in the art, a bypass air passageway is arranged in parallel with throttle plate 62 to control inducted airflow during idle speed control via a throttle control valve positioned within the air passageway. In some embodiments, an intake passage of engine 10 may include a turbocharger or supercharger shown schematically at 63. Turbocharger 63 may include a compressor arranged upstream of the cylinder and/or a turbine (not shown) for powering the compressor arranged in an exhaust passage downstream of the cylinder. Turbocharger 63 may be controlled by controller 12 to vary the turbocharging provided to one or more cylinders of the engine.

Exhaust gas sensor 76 is shown coupled to exhaust manifold 48 upstream of catalytic converter 70. Note that sensor 76 can corresponds to various different sensors, depending on the exhaust configuration. Sensor 76 may be any of many known sensors for providing an indication of exhaust gas air/fuel ratio such as an exhaust gas oxygen (EGO) sensor, linear oxygen sensor, a UEGO, a two-state oxygen sensor, a HEGO, or an HC or CO sensor. In this particular example, sensor 76 is an exhaust gas oxygen sensor that provides signal EGO to controller 12. For example, a higher voltage state of signal EGO signal indicates exhaust gases are rich of stoichiometry and a lower voltage state of signal EGO indicates exhaust gases are lean of stoichiometry. Signal EGO may be used to advantage during feedback and/or feedforward air/fuel control to maintain average air/fuel at stoichiometry, above stoichiometry or below stoichiometry operation. Further, as will be described in greater detail herein fuel delivery may be control during some conditions in response to EGO sensing.

Conventional distributorless ignition system 88 provides ignition spark to combustion chamber 30 via spark plug 92 in response to spark advance signal SA from controller 12. Though spark ignition components are shown, engine 10 (or a portion of the cylinders thereof) may not include spark ignition components in some embodiments and/or may be operated without requiring a spark.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give and indication of engine load. Further, this sensor, along with engine speed, can provide an estimate of charge (including air) inducted into the cylinder. In one example, sensor 118, which is also used as an engine speed sensor, produces a predetermined number of equally spaced pulses every revolution of the crankshaft. Controller 12 may be configured to cause combustion chamber 30 to operate in various modes of operation including homogeneous or stratified spark ignition or compression ignition modes, for example. Controller 12 can control the amount of fuel delivered by fuel injector 66 so that the air/fuel mixture in cylinder 30 can be selected to be at stoichiometry, a value rich of stoichiometry, or a value lean of stoichiometry. Similarly, controller 12 can control the amount of fuel vapors purged into the intake manifold via fuel vapor purge valve 168 communicatively coupled thereto.

As described above, FIG. 1 merely shows one cylinder of a multi-cylinder engine as each cylinder may have its own set of intake/exhaust valves, fuel injector, spark plug, etc.

As described above with reference to FIG. 1, fuel pressure within the fuel system may be controlled by the control system via the fuel pump in response to an output signal from the fuel pressure sensor. For example, during operation of the engine, the amount of pumping and hence the pressure provided to the fuel rail by the high pressure fuel pump can be varied responsive to the pressure detected by the fuel pressure sensor using a feed-forward (e.g., based on desired engine torque, engine airflow, etc) and/or feedback approach. As one approach, the fuel rail pressure may be controlled using a feed-forward controller and/or a PI (proportional-integral) or PID (proportional-integral-derivative) controller including an adaptive term for learning feed-forward errors. In this manner, the pressure provided to the fuel injector(s) may be controlled so that the combination of fuel pressure and pulse width of the fuel injection results in the desired amount of fuel delivered to the engine, even when various engine operating conditions vary.

However, during a failure or degraded state of the fuel pressure sensor, the output of the fuel pressure sensor may not accurately reflect the actual fuel pressure of the fuel system. Similarly, the amount of fuel delivered to the engine may also depend on the pulse width provided to the fuel injector, which in turn may be controlled in response to fuel pressure. Further, the outputs of the PI (or PID) controller and/or adaptive terms of the control system may be dependent upon the output of the fuel pressure sensor.

In one approach, the above issues may be addressed through the use of exhaust gas sensing to provide feedback to the fuel pump during a condition where operation of the fuel pressure sensor is degraded and/or has failed. For example, a closed loop air/fuel ratio controller may be used to provide feedback to the control system based on the detected air/fuel ratio in the exhaust gases produced by the engine.

Figure 2:
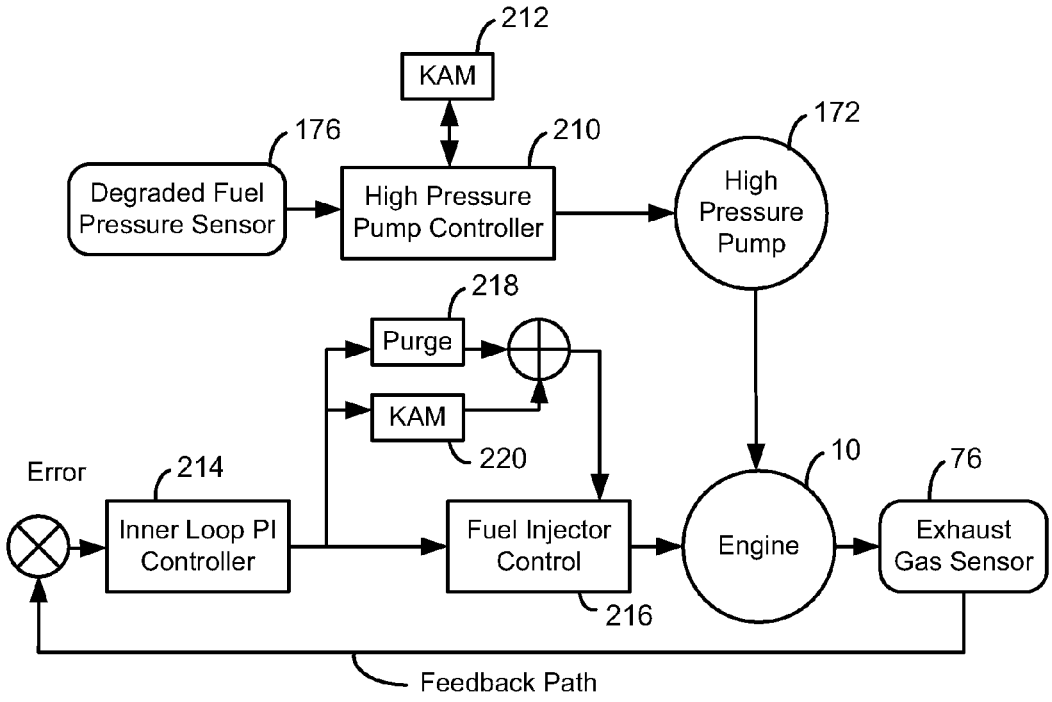
FIG. 2 shows an approach for controlling fuel delivery to the engine during a first condition of a fuel pressure sensor.
Figure 3:
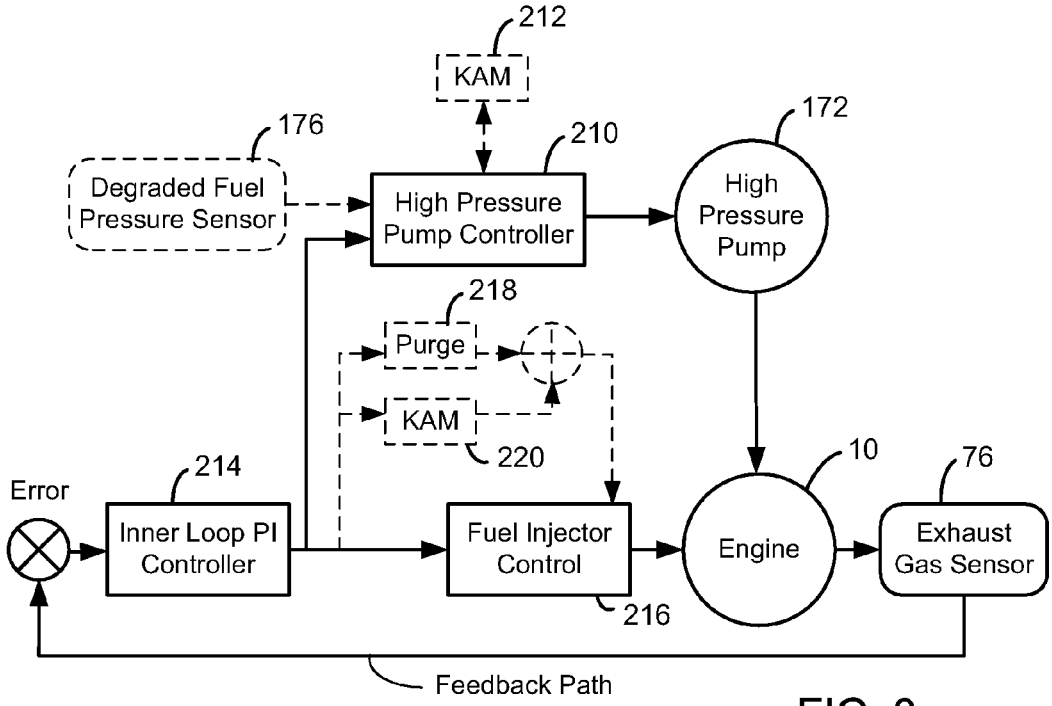
FIG. 3 shows an approach for controlling fuel delivery to the engine during a second condition of the fuel pressure sensor.

FIGS. 2 and 3 show example control diagrams for controlling the delivery of fuel to at least one cylinder of an engine as may be performed as described above with reference to FIG. 1. Specifically, FIG. 2 schematically shows a control approach that may be used during non-degraded conditions of fuel pressure sensor 176. During this condition, high pressure fuel pump 172 may receive control signals from high pressure fuel pump controller portion 210 of the control system. High pressure fuel pump controller 210 may receive control information from fuel pressure sensor 176. Further, control information may be written to and/or read from KAM 212 by high pressure pump controller 210. Further still, fuel vapors may be purged in the engine during this condition.

Continuing with FIG. 2, exhaust gases produced by the engine can be detected by exhaust gas sensor 76. An output signal of exhaust gas sensor 76 can be used as a feedback path to evaluate the error between a desired air/fuel ratio and an actual air/fuel ratio as detected by exhaust gas sensor 76. This error may be provided to inner loop PI controller 214 that can provide control information to fuel injector control portion 216 of the control system. Inner loop PI controller 214 is also shown providing control information to the fuel vapor purging system shown generally at 218 and KAM 220, which may also be used to provide control information to fuel injector control portion 216. The fuel injector control portion 216 may provide control signals to engine 10 to cause a corresponding pulse width to be sent to fuel injector 66. In this way, the control system can accurately determine an amount of fuel vapors present during the purging operation, and/or adaptively learn fuel injector or air metering errors, as well as accurately control engine air/fuel ratio.

FIG. 3 schematically shows another control approach that may be used during a degraded condition of the fuel pressure sensor. As described herein, a degraded condition may include conditions where the accuracy of the sensor is reduced or other degraded conditions. During a degraded condition of fuel pressure sensor 176, high pressure fuel pump controller 210 may reduce or discontinue providing control signal output based on the control information received from the degraded fuel pressure sensor and instead or additionally utilize control information from inner loop PI controller 214, which is based at least partially on feedback from exhaust gas sensor 76. Further, fuel vapor purging provided by fuel vapor purging system 218 may be reduced or stopped, and adaptive learning of the fuel injector errors and/or the high pressure fuel pump errors may be disabled or reduced, for example, by reducing or eliminating updates to KAM 212 and/or 220 as indicated by the broken lines of FIG. 3.

In some conditions where the fuel pressure sensor is still functioning, but is providing less accurate indication of the fuel pressure, the high pressure pump controller may continue to utilize the control information provided by the degraded fuel pressure sensor in addition to feedback from the exhaust gas sensor. Similarly, adaptive learning of the fuel pump errors and/or fuel injector errors may be continued where the fuel pressure sensor is providing control information that is suitable for controlling the high pressure fuel pump and/or the fuel injector.

In this way, it is possible to continue to provide accurate fueling to the engine, even when the fuel pressure sensor has degraded.

Figure 4:
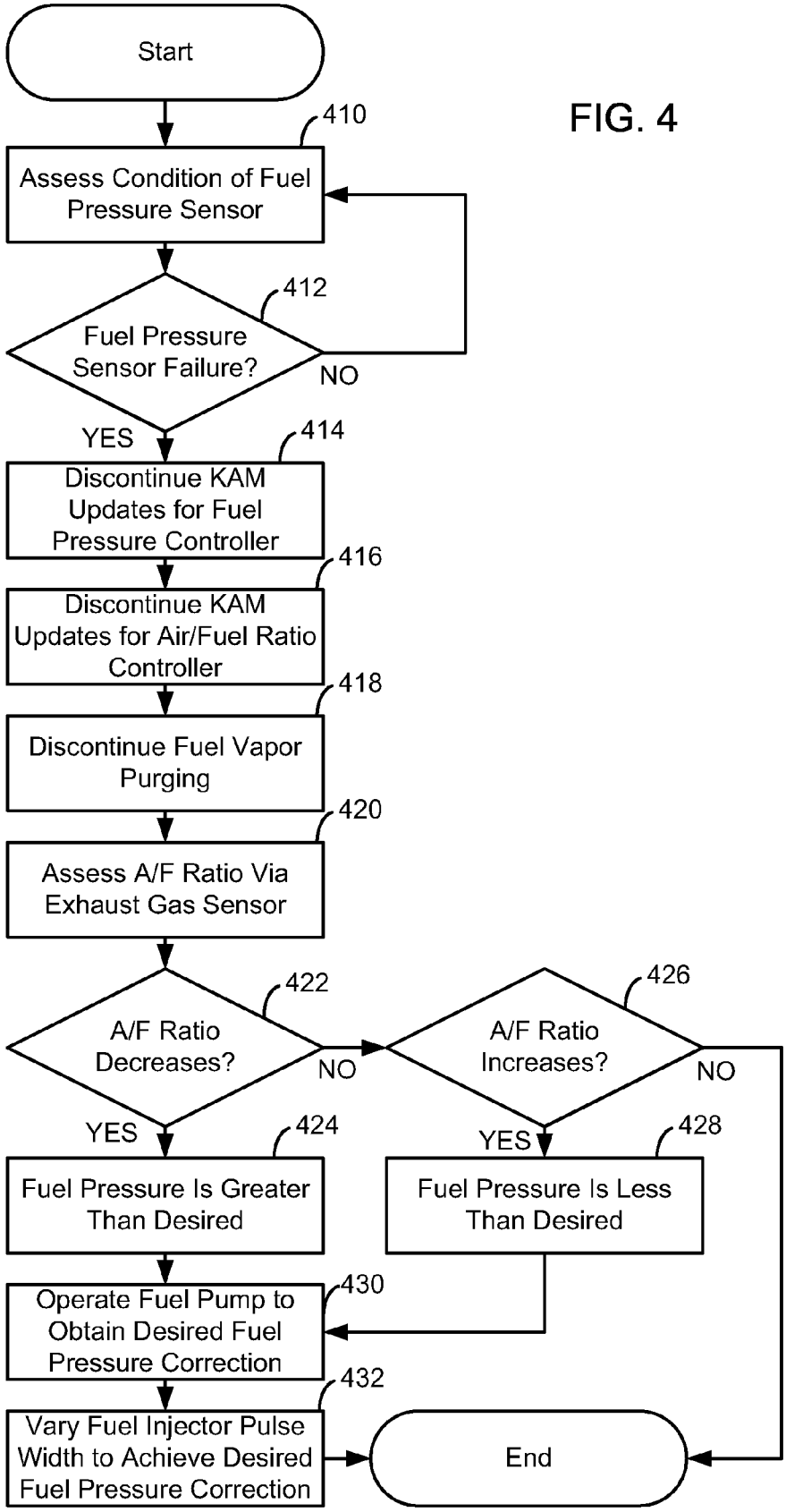
FIG. 4 shows a flow chart of an example approach for controlling fuel delivery during a fuel pressure sensor failure.

FIG. 4 shows a flowchart of an example control strategy for maintaining the desired fuel delivery to the engine in response to a degraded condition of the fuel pressure sensor as described above with reference to FIG. 3. At 410, the operative condition of the fuel pressure sensor may be assessed. This assessment may include monitoring of the fuel pressure sensor output for abnormalities or discontinuities that may be indicative of sensor degradation (e.g. sensor failure or decreased accuracy). In one approach, the control system may monitor the output of the fuel pressure sensor for abnormal signals that may not otherwise be caused by the current operating conditions of the engine. For example, if the fuel pressure measurement as indicated by the sensor provides a substantially higher or lower pressure measurement and/or a rapid pressure rate of change, then the control system may determine that the pressure sensor has experienced a failure. Further, the control system may resolve whether the pressure sensor degradation has occurred or the transient fuel pressure behavior is caused by other issues such as degradation or failure of the fuel pump, fuel injector, fuel system, or various other sensors. In another approach, the control system may compare the air/fuel (A/F) ratio as measured by the exhaust gas sensor to the fuel pressure sensor measurement. If a possible degradation of the fuel pressure sensor has been detected via an abnormal pressure measurement, then the exhaust gas sensor may be used to determine whether the abnormal pressure measurement has been caused by an actual change in the fuel pressure or by the failure of the pressure sensor. For example, an actual change in the fuel pressure may result in a corresponding change in the expected air/fuel ratio.

At 412, it may be judged whether a degradation of the fuel pressure sensor has occurred. While degradation may include degraded operation or an inoperative state of the sensor, in an alternative embodiment, if the fuel pressure sensor has experienced degraded performance and is not completely inoperative, it may be judged that a degradation of the fuel pressure sensor has not occurred. For example, a degradation of the sensor may be corrected by varying the pulse width signal supplied to the fuel injector and/or by varying the amount of fuel pressure supplied by the fuel pump. If the answer at 412 is no, the routine may return to 410 where the pressure sensor may be continually assessed or the routine may alternatively end.

If the answer at 412 is yes, then the KAM updates may be discontinued or reduced for the fuel pressure controller at 414 and the air/fuel ratio controller 416 portions of the control system. In this manner, the dependency of the control system on the pressure sensor output may be reduced or eliminated, thereby enabling improved fuel pressure control via one or more other sensor feedback loops. For example, the routine may discontinue adaptive learning of fuel injector characteristics (such as slopes and offsets between PW and delivered fuel at a given pressure), fuel pump characteristics, air metering errors, and/or others. At 418, the purging of fuel vapors into the intake manifold may be discontinued or reduced. For example, fuel vapor purging may be completely discontinued, where the fuel vapors may be stored in the fuel vapor canister and/or purged to a location other than the intake passage of the engine, for example, or simply stored without purging, or purged only during limited conditions. In this manner, the variability and uncertainty of the amount of fuel supplied to the engine may be reduced, at least during some conditions. In an alternative embodiment, the purging of fuel vapors may be reduced by varying the position of the purge valve. In yet another embodiment, the purging of fuel vapors may be controlled to remain substantially constant.

At 420, the air/fuel ratio of the engine may be assessed via an exhaust gas sensor such as for example, exhaust gas sensor 76 described above with reference to FIG. 1. In this manner, the amount of fuel delivered to the combustion chamber may be determined or estimated. At 422, it may be judged whether the air/fuel ratio has been detected to become richer (i.e. an air/fuel ratio decrease corresponds to an increase in fuel injected). A richer air/fuel ratio than expected can be interpreted by the control system to be indicative of an increase in fuel pressure at 324. Alternatively, if it is judged at 426 that the air/fuel ratio becomes leaner than expected, then it may be determined that the fuel pressure is lower than desired at 428.

At 430, the fuel pump can be operated to obtain the desired fuel pressure correction. For example, if the fuel pressure is determined to be less than desired, the fuel pump can be operated to increase the fuel pressure. Alternatively, if the fuel pressure is determined to be greater than desired, then the amount of pumping provided by the fuel pump can be reduced or discontinued. At 432, the fuel injector can be operated as desired to aid in correcting the fuel pressure. In one approach, the pulse width of the signal sent to the fuel injector may be adjusted in response to the fuel pressure detected by the exhaust gas sensor. For example, the pulse width of the injection may be increased in proportion to a fuel pressure deficit and may be decreased in response to a fuel pressure surplus.

In some embodiments, the fuel injection pulse width can be adjusted to provide a more rapid response than the fuel pump to correct the air/fuel ratio. For example, if the fuel pressure is detected to be higher than desired, then the pumping provided by the fuel pump may be reduced and/or discontinued while the pressure is gradually reduced (or reduced slower than the pulse width change) over the course of fueling the engine. This reduction of pressure may occur over a plurality of cycles; therefore, the pulse width of the fuel injection may be adjusted over the plurality of cycles to maintain the desired fuel delivery even when the fuel pressure is greater than or less than desired. Likewise, if the fuel pressure is detected to be lower than desired, then the pumping provided by the fuel pump may be increased and/or the pulse width of the fuel injector may be increased to achieve the desired fueling of the cylinder. Finally, the routine may end.

Figure 5:
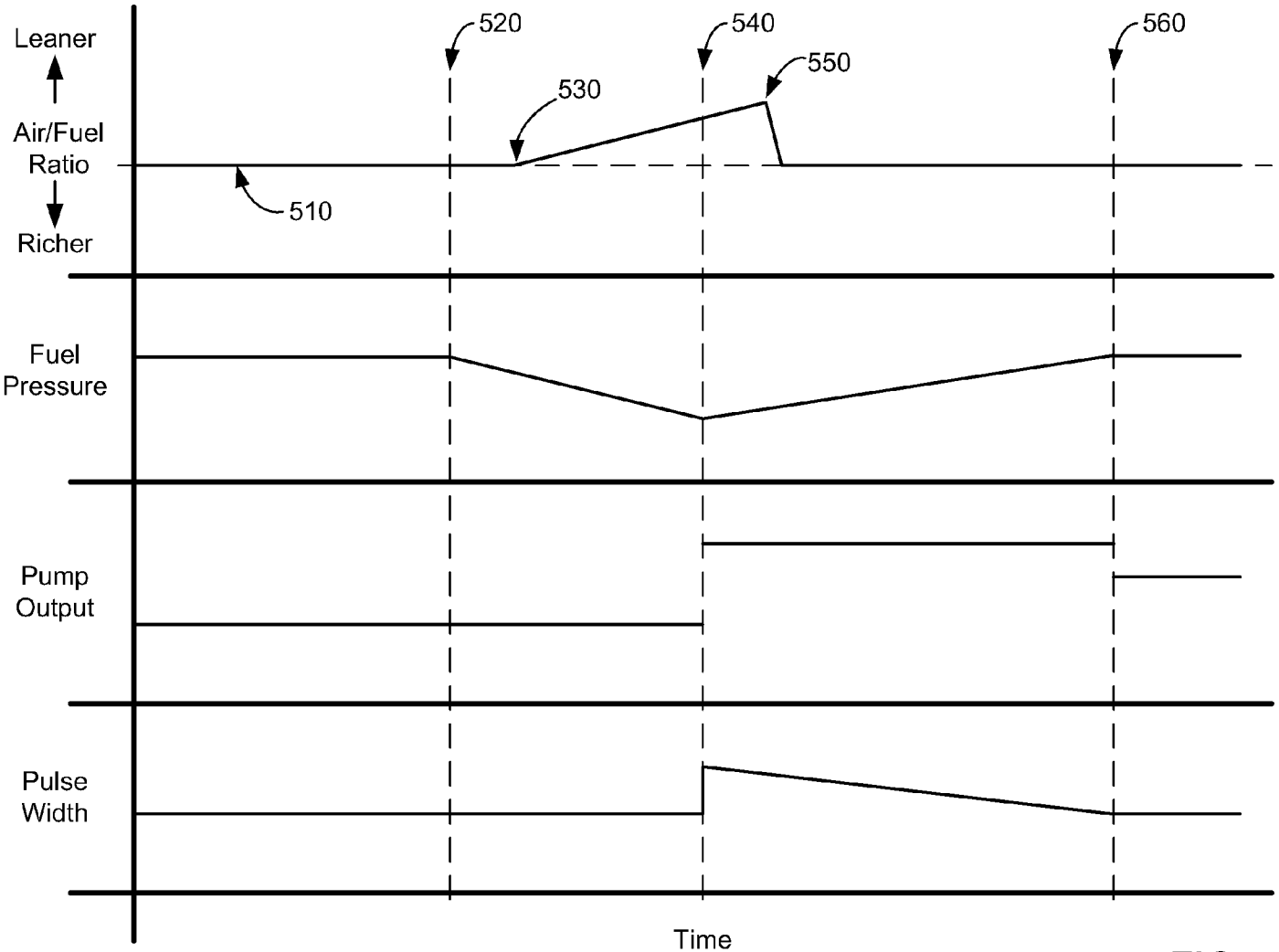
FIG. 5 shows a graph of an example scenario including a fuel pressure sensor failure.

FIG. 5 shows an example scenario where the routine of FIG. 4 may be used to respond to degradation of the fuel pressure sensor. The graph of FIG. 5 shows a prophetic example of air/fuel ratio as detected in the exhaust gas, fuel pressure, fuel pump output (i.e. pumping), and pulse width of the fuel injector plotted on the vertical axis and time plotted on the horizontal axis. The engine (or at least one cylinder thereof) is shown initially operating at a desired steady state air/fuel ratio shown generally at 510. The desired air/fuel ratio may be stoichiometry, rich of stoichiometry or lean of stoichiometry, and may be changing with time. The fuel pressure, fuel pump output, and pulse width of the fuel injector are also shown initially operating at substantially steady state in response to the engine operating conditions to maintain the desired air/fuel ratio. At a later time indicated by 520, the fuel pressure sensor may degrade, potentially resulting in reduced fuel pressure control. As the fuel pressure sensor degradation is detected, fuel vapor purging operations may be discontinued and the KAM updates to the fuel pump control and the fuel injection control may be stopped, reduced, and/or adjusted.

In this example, the fuel pressure is shown to decrease with time after 520, however the fuel pressure may alternatively increase as fuel pressure sensor feedback is momentarily unavailable. As the fuel pressure begins to drift, the air/fuel ratio as detected by the exhaust gas sensor may begin to increase (i.e. become leaner) at a later time indicated at 530 (e.g. due to a time lag between fueling of the cylinder and detection of the exhaust gases) in response to the decrease in fuel pressure, which may cause a corresponding reduction of fuel delivered to the cylinder. At 540, corrective action may be initiated in response to a threshold deviation in the air/fuel ratio, for example, in order to maintain the desired air/fuel ratio. For example, at 540, the fuel pump output may be increased in response to the detected lean air/fuel ratio to increase fuel pressure. However, the pressure provided to the fuel rail by the increase in pumping may respond over an interval of time. In some examples, the corresponding fuel pressure may increase slower than desired after the pump output is increased. Therefore, the pulse width of the fuel injector may also be increased at 540 to provide a faster response to maintain the desired air/fuel ratio.

As the fuel pressure begins to increase due to the increased pumping provided by the fuel pump, the pulse width of the fuel injector may be correspondingly reduced, for example, over one or more cycles so that the desired air/fuel ratio is maintained. At 550, the air/fuel ratio detected in the exhaust gas is shown to begin decreasing toward the desired value due to lag between fuel injection and detection of the exhaust gases. Between 550 and 560, the pulse width may be decreased in response to the detected air/fuel ratio as the fuel pressure is increased by the fuel pump. At 560, it may be determined that the fuel pressure has reached the desired value in response to the desired air/fuel ratio, wherein the fuel injector pulse width and/or the pump output may be reduced. In this manner, the fuel pressure control may be maintained even when fuel pressure sensor degradation occurs. Furthermore, faster response to fuel pressure errors may be achieve by varying the pulse width to maintain the desired air/fuel ratio as the fuel pump is controlled to vary the fuel pressure.

It will be appreciated that the configurations, systems, methods, and routines disclosed herein are exemplary in nature, and that these specific embodiments are not to be considered in a limiting sense, because numerous variations are possible. For example, the above approaches can be applied to V-6, I-3, I-4, I-5, I-6, V-8, V-10, V-12, opposed 4, and other engine types.

The specific routines described herein by the flowcharts and the specification may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the example embodiments of the invention described herein, but is provided for ease of illustration and description. Although not explicitly illustrated, one or more of the illustrated steps or functions may be repeatedly performed depending on the particular strategy being used. Further, these figures may graphically represent code to be programmed into the computer readable storage medium of the vehicle control system. Further still, while the various routines may show a "start", "return" or "end" block, the routines may be repeatedly performed in an iterative manner, for example.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of controlling an internal combustion engine having a fuel vapor purging system and a fuel delivery system including a fuel pump and a fuel pressure sensor for detecting fuel pressure provided by the fuel pump, the method comprising:

during a degraded condition of the fuel pressure sensor, adjusting an output of the fuel pump in response to an operating condition, adjusting a condition of the fuel vapor purging system; and further adjusting the fuel pump output in response to an output of an exhaust gas sensor while also adjusting an amount of fuel injected into a cylinder of the engine in response to said output of the exhaust gas sensor, said further adjusting the fuel pump output after adjusting said condition of the fuel vapor purging system.

2. The method of claim 1, wherein the operating condition includes an indication of needed fuel pressure.

3. The method of claim 1, wherein the condition of the fuel vapor purging system includes an amount of fuel vapors purged to the engine, and wherein said adjusting of the condition of the fuel vapor purging system includes reducing the amount of fuel vapors purged to the engine.

4. The method of claim 3, wherein said reducing the amount of fuel vapors includes disabling the purging of fuel vapors to the engine.

5. The method of claim 1, further comprising adjusting adaptive learning of a characteristic of the fuel delivery system by reducing adaptive learning of the characteristic of the fuel delivery system.

6. The method of claim 5, wherein said reducing adaptive learning of the characteristic of the fuel delivery system includes discontinuing updates to a keep alive memory.

7. The method of claim 1, wherein the fuel delivery system includes a fuel rail and the fuel pressure sensor is configured to detect the fuel pressure within the fuel rail.

8. The method of claim 1, wherein the fuel delivery system includes a fuel injector for injecting fuel directly into the cylinder.

9. The method of claim 8, wherein said adjusting an amount of fuel injected into the cylinder includes varying a pulse width of a control signal sent to the fuel injector in response to said output of the exhaust gas sensor.

10. A method of controlling an engine having at least one cylinder, the method comprising:

during a first condition, adjusting an output of a fuel pump based on a fuel pressure within a fuel rail operatively coupled to the fuel pump, and adjusting an amount of fuel injected into the at least one cylinder based on an output of an exhaust gas sensor downstream of the at least one cylinder; and during a second condition including when a fuel pressure sensor is degraded, adjusting the output of the fuel pump and the amount of fuel injected into the at least one cylinder based on the output of the exhaust gas sensor, wherein said adjustment of the amount of fuel injected is at a higher bandwidth than said adjustment of the output of the fuel pump.

11. The method of claim 10 wherein said first condition includes when the fuel pressure sensor functions at an acceptable level.

12. The method of claim 11 further comprising disabling fuel vapor purging during at least a portion of said second condition and purging fuel vapors during at least a portion of said first condition.

13. A method of controlling an internal combustion engine having a fuel vapor purging system and a fuel delivery system including a fuel pump and a fuel pressure sensor for detecting fuel pressure provided by the fuel pump, the method comprising:

during a first condition, operating the fuel pump in response to an output of the fuel pressure sensor and purging a first amount of fuel vapors to the engine; and during a second condition, operating the fuel pump in response to an output of an exhaust gas sensor arranged in an exhaust passage downstream of the engine and purging less fuel vapors to the engine than said first amount.

14. The method of claim 13, wherein the second condition includes a degraded state of the fuel pressure sensor.

15. The method of claim 14, wherein the first condition includes at least one of a non-degraded state of the fuel pressure sensor and a normal operating state of the fuel pressure sensor.

16. The method of claim 13, wherein during the second condition the purging of fuel vapors to the engine is at least temporarily discontinued.

17. The method of claim 13, wherein the engine further includes a control system including an adaptive learning system for learning a characteristic of the fuel delivery system and wherein the method further includes disabling at least a portion of the adaptive learning system during the second condition.

18. The method of claim 13 further comprising, varying an amount of fuel injected into a cylinder of the engine in response to the output of the exhaust gas sensor at least during the second condition.

19. The method of claim 18 further comprising varying the amount of fuel injected into the cylinder in response to an output of the fuel pump.

20. The method of claim 18 further comprising varying a pulse width of the fuel injected into the cylinder faster than the fuel pressure is varied by the fuel pump.

* * * * *